United States Patent [19]

Carlson et al.

[11] 4,230,785

[45] Oct. 28, 1980

[54] PRESSURE SENSITIVE ADHESIVE ELECROPHOTOGRAPHIC REPRODUCTION SHEETS

[75] Inventors: Lee A. Carlson, Southboro; Richard G. Miekka, Sudbury, both of Mass.

[73] Assignee: Dennison Manufacturing Company, Framingham, Mass.

[21] Appl. No.: 881,332

[22] Filed: Feb. 27, 1978

Related U.S. Application Data

[63] Continuation of Ser. No. 655,595, Feb. 5, 1976, abandoned, which is a continuation of Ser. No. 327,536, Jan. 29, 1973, abandoned, which is a continuation of Ser. No. 86,950, Nov. 4, 1970, abandoned.

[51] Int. Cl.[3] ..... G03G 5/02

[52] U.S. Cl. ..... 430/56; 430/60; 430/63; 283/18; 428/40; 428/345; 428/352

[58] Field of Search ..... 428/40, 345, 352; 283/18; 430/60, 56, 63

[56] References Cited

U.S. PATENT DOCUMENTS

| | | | |
|---|---|---|---|
| 3,861,912 | 1/1975 | Ibrahim | 96/1.5 |
| 3,907,557 | 9/1975 | Bolduc | 96/1.8 |

*Primary Examiner*—Dennis E. Talbert, Jr.
*Assistant Examiner*—John L. Goodrow
*Attorney, Agent, or Firm*—George E. Kersey

[57] ABSTRACT

A pressure sensitive adhesive rendered electrically conductive without adversely affecting pressure sensitive adhesiveness by adding thereto electrically conductive material.

Where a conductive pressure sensitive adhesive layer is used in the form of a coating on a backing sheet, the protective release sheet or liner for the pressure sensitive adhesive coating may also be rendered conductive by the inclusion of electrically conductive material therein so that the thickness of the laminate is conductive.

9 Claims, No Drawings

PRESSURE SENSITIVE ADHESIVE ELECROPHOTOGRAPHIC REPRODUCTION SHEETS

This is a continuation of Ser. No. 655,595, filed Feb. 5, 1976, abandoned, which was a continuation of our application U.S. Ser. No. 327,536, filed Jan. 29, 1973, abandoned, which was a continuation of our application Ser. No. 86,950, filed Nov. 4, 1970, abandoned.

SUMMARY OF THE INVENTION

Conventional electrophotographic reproduction sheets comprise an electrophotographic layer, made up of photoconductive particles, usually zinc oxide, embedded in an insulating resin (usually a dye sensitizer is also included), applied to an electrically conductive backing sheet, which is usually an electrically conductive paper, made electrically conductive by coating or impregnating with an electrically conductive material. In most cases, a thin hold-out coating, such as starch or casein together with an adhesive promoting resin, is applied to the backing sheet before application of the electrophotographic layer or coating.

In accordance with the present invention, a layer of pressure sensitive adhesive is applied to the side of the backing sheet opposite the electrophotographic layer, and, preferably, a peelable protective release sheet or liner is releasably applied over the pressure sensitive adhesive layer to protect it. The surface of the liner in contact with the pressure sensitive adhesive is made of a material having low adhesion to such adhesive so that the liner can be easily peeled off the pressure sensitive adhesive. By peeling the liner off the electrophotographic sheet (the adhesive bond between the pressure sensitive adhesive layer and the backing sheet is strong compared to that between the adhesive layer and the liner and is substantially permanent), it, the electrophotographic sheet (the electrophotographic layer-backing sheet—pressure sensitive adhesive layer laminate), can be adhesively stuck to a receiving surface in the manner of conventional pressure sensitive adhesive labels.

Accordingly, these sheets are useful as pressure sensitive labels which can be printed electrophotographically in conventional electrophotographic machines. Thus, the invention provides a pressure sensitive label, the printing surface of which is supplied with an electrophotographic layer for electrophotographic printing, thereby providing a fast, inexpensive and novel method of printing pressure sensitive labels.

However, a serious problem in achieving satisfactory electrophotographic reproduction with such a composite sheet was that in conventional electrophotography it is necessary for the substrate supporting the electrophotographic layer to be sufficiently conductive throughout its thickness (through conductivity) for the charge to leak through the thickness of the substrate at a sufficiently rapid rate during reasonable exposure times, whereas the pressure sensitive adhesive layer, which becomes a part of such substrate, is non-conductive and, in the minimum thickness required for good pressure sensitive adhesion, functions as an electrical insulating barrier or dielectric to thereby prevent the required through leakage of charge.

This problem was overcome in accordance with the present invention by either (1) incorporating a highly conductive, electrically unipotential layer or surface, preferably a flexible, thin, highly conductive continuous metal layer, between the electrophotographic layer and the pressure sensitive adhesive layer and/or (2) incorporating in the non-conductive pressure sensitive layer a sufficient amount of conductive material to render the layer adequately conductive to pass the charge therethrough at a rate, which will permit reasonable exposure times and which is commensurate with or greater than the rate achieved in conventional, ionically conductive electrophotographic papers. Of the aforesaid alternatives (1) and (2), the use of a unipotential layer with a conventional non-conductive pressure sensitive adhesive layer is preferred.

It has been discovered that when either of these is done, excellent electrophotographic reproduction can be achieved in conventional electrophotographic equipment.

Where a unipotential layer is not used and the pressure sensitive adhesive layer is made conductive by adding conductive material, improved results are achieved by also incorporating in the protective release sheet or liner, sufficient conductive material to increase its through conductivity also. However, since conventional release liners are quite thin, they do not ordinarily present an absolute insulating barrier to through conductivity. Accordingly, electrophotographic reproduction can be achieved without incorporating in the liner conductive material to make it conductive, although quality of reproduction is decreased.

The term electrically unipotential layer or surface means that the surface is so highly conductive that the electrical potential at every unit area is substantially the same at any given instant under electrophotographic exposure conditions, i.e. the surface is so highly conductive that there is no substantial voltage difference, i.e. difference in potential, between different areas of the surface at any given time, as distinguished from the more limited conductance achieved with conventional conductive resin coatings used in electrophotography, such as coatings containing, or consisting primarily of, poly quaternary ammonium salts, which are conductive resins, and coatings of non-conductive resins to which a highly ionizable inorganic salt has been added to render them ionically conductive. These ionically conductive coatings are ordinarily applied to electrophotographic paper to render the paper conductive. Also, the paper substrate itself is sometimes impregnated with the inorganic salt or conductive resin to render it ionically conductive. Such conventional conductive resin coatings are quite thin, which limits their conductance. However, in the case of the conductive resin coatings, by increasing the thickness or weight thereof substantially beyond conventional amounts, i.e. by increasing it to greater than five lbs. per 3,000 square feet ream, it is possible to achieve a conductance approaching unipotential conductance as above defined.

A continuous surface of highly conductive metal such as silver, aluminum, gold, copper, etc. or conductive carbon presents an electrically unipotential surface. A metal surface is preferred because of its greater conductivity. The metal layer forming the metal surface should preferably be quite thin and highly flexible and may be in the form of a thin (e.g. a fraction of a mil thick, i.e. 0.1–0.6 or 0.8 mil) flexible metal foil, as such, or laminated to a thin flexible paper or plastic, e.g. polyvinyl, sheet for supporting strength. A vacuum metallized paper or plastic sheet can be used.

The thin metal layer may, itself, constitute the backing sheet for the electrophotographic layer. However, as aforesaid, preferably a laminate thereof with a thin flexible paper or plastic sheet is preferred as the backing sheet since such a thin metal layer lacks strength. Conventional metal foil laminated and vacuum metallized paper or resin coated foil can be used.

Preferably, the electrophotographic layer is applied to the metal surface of the backing sheet directly or through a very thin adhesion promoting layer, e.g. polyvinyl chloride, polyvinyl acetate, styrene-butadiene, copolymers of polyvinyl chloride and polyvinyl acetate, nitrocelluose, etc. to better secure the layer to the metal.

The pressure sensitive adhesive layer is applied to the opposite surface of the backing sheet either directly or through a conventional thin adhesion promoting layer to more permanently secure the pressure sensitive adhesive layer to the backing sheet and thereby insure against the pressure sensitive adhesive layer pulling away from the backing sheet when the protective release liner is peeled off the adhesive layer and when the electrophotographic pressure sensitive sheet is applied to the receiving surface. Where the backing sheet comprises a metal-paper laminate, e.g. conventional metal foil laminated paper, the pressure sensitive adhesive layer usually adheres to the paper surface with sufficient strength so that an adhesion promoting layer bonding it more strongly to the backing sheet is not required. The same is also true of the plastic surfaces of many metal-plastic laminate backing sheets. Such an adhesion promoting layer, forming a strong bond with both the backing sheet and the pressure sensitive adhesive layer, is useful, however, when the nature of the backing sheet surface to which the pressure sensitive adhesive is applied is such that it poorly adheres to the pressure sensitive adhesive, particularly where such adhesion is poorer than or approaches that of the adhesive bond between the pressure sensitive adhesive and the release sheet, as may be the case where the surface to which the pressure sensitive adhesive is applied is a metal surface. In any event the bond between the backing sheet and pressure sensitive adhesive should be substantially stronger than the bond between the pressure sensitive adhesive and the release sheet and may be considered as substantially permanent in the same sense that in conventional pressure sensitive labels, the bond between the pressure sensitive adhesive and its supporting sheet is substantially permanent and is not intended to be broken.

Where an adhesion promoting layer, which is normally non-conductive, is used to more permanently secure the electrophotographic layer to the metal surface it should either be so thin that it will not form a barrier to conductivity of the charge through the thickness thereof or it should contain electrically conductive material, such as an electrically conductive resin or a highly ionizable, water soluble, inorganic salt of a mineral acid. Preferably it is made as thin as possible.

The electrophotographic layer may be applied to the paper or plastic side of the metal-paper or metal-plastic laminated backing sheet and the pressure sensitive adhesive layer may be applied to the metal surface. In such case, the paper or plastic layer must be rendered conductive in the manner of conventional electrophotographic conductive base sheets, e.g. conductive paper. Also, in such case, a thin adhesion promoting layer is preferably applied to the metal surface, as aforesaid, for stronger adhesion of the pressure sensitive adhesive layer to the metal surface. Also, a conventional hold-out coating is preferably applied to the paper or plastic surface and the electrophotographic layer is applied to the hold-out coating in conventional manner. Where the electrophotographic layer is applied to the metal surface a hold-out coating is not required since the metal layer acts as a hold-out layer, i.e. it prevents penetration into the paper backing sheet of the solvent in the electrophotographic composition during the coating operation.

Although a conductive metal foil support, to which the electrophotographic layer is applied, has been disclosed in the prior art, such support is sufficiently conductive through its entire thickness to leak the charge therethrough during conventional exposure times, and it is indeed surprising that the use of a continuous metal surface makes possible inclusion, in an electrophotographic sheet for use with conventional electrophotographic copiers, of an insulating barrier to through conductivity, i.e. the pressure sensitive adhesive layer, without deleteriously effecting electrophotographic reproduction.

Where an electrically unipotential surface is used, the pressure sensitive adhesive layer may be the same in formulation and thickness as the pressure sensitive adhesive layers of conventional pressure sensitive labels.

Where a conductive pressure sensitive adhesive layer is used instead of, or in combination with, a conductive metal layer, the conductive material or medium incorporated in the pressure sensitive adhesive layer to make it conductive preferably comprises finely divided, highly electrically conductive particles, such as electrically conductive metal particles, electrically conductive carbon particles, i.e. carbon black, or particles of electrically conductive zinc oxide, electrically conductive tin oxide or other electrically conductive metal oxides, embedded in and distributed uniformly throughout the pressure sensitive adhesive layer in sufficient quantity to achieve particle-to-particle contact throughout such layer to thereby provide electrically conductive paths therethrough for leakage of the charge from the electrophotographic layer during exposure. The finely divided conductive metal particles may be of silver (e.g. milled precipitated silver particles), gold, copper, aluminum, platinum, etc. and may be in the form of flakes, spheres, powders, etc.

The particle size of the conductive particles should be substantially smaller than the thickness of the pressure sensitive adhesive layer, which is usually in the nature of about a mil thick, and may range from a fraction of a micron to 15 or 20 microns, preferably 0.5 microns to 2 or 3 microns. However, where thicker pressure sensitive adhesive layers are used the particle sizes may be larger.

Less preferred conductive materials for incorporation in the pressure sensitive adhesive layer are the conductive resins, such as the polyquaternary ammonium resins, e.g. those sold under the name DOW QX resins (polyvinyl benzyl trimethyl ammonium chloride) by Dow Chemical Company, and under the name Calgon 261 by Calgonite Corporation and under the name DeSoto 104 by the DeSoto Chemical Company. Still less preferred conductive materials are highly ionizable, water soluble salts, preferably ammonium and alkali metal salts, of the strong mineral acids, such as potassium chloride.

These conductive resins and inorganic salts provide ionic conductivity by virtue of their ionizability and, when admixed with the pressure sensitive adhesive, render it ionically conductive. The use of conductive resins and inorganic salts to render the pressure sensitive adhesive layer conductive is not preferred because these materials are hydrophilic in nature, whereas the pressure sensitive adhesive is water insensitive so that their compatibility is limited. This is especially true of the inorganic salts, which tend to absorb substantial amounts of moisture, which detracts from the efficiency of the pressure sensitive adhesive.

The minimum amount of electrically conductive medium added to the pressure sensitive adhesive is that which gives it sufficient through conductivity to permit leakage of charge through the thickness thereof during the exposure time desired. The maximum amount is that beyond which the cohesiveness and pressure sensitive adhesiveness of the adhesive is unduly decreased since these electrically conductive materials do not themselves have pressure sensitive adhesiveness and, accordingly, when added to the pressure sensitive adhesive, they reduce the cohesiveness and adhesiveness thereof.

Conventional protective release sheets or liners for pressure sensitive adhesive labels are either themselves made of a material which has low adhesion to the pressure sensitive adhesive, e.g. glassine, silicone, etc., or they are coated with such a material, e.g. a silicone coated paper or plastic, such as a vinyl sheet, so that they can be readily peeled off from the adhesive to expose it without removing the adhesive from the backing sheet of the label. Such release sheets can be used in the present invention. Although they are non-conductive they are so thin they do not present an absolute barrier to leakage of charge through the thickness thereof.

However, they do interfere with through flow of charge to some extent and, accordingly, when a conductive pressure sensitive adhesive layer is used without a unipotential layer, substantially better electrophotographic reproduction is achieved by incorporating in the release sheet the aforesaid electrically conductive materials to increase the conductive rate of flow of charge therethrough, a preferred amount being that which will provide a rate of flow of charge through the thickness thereof commensurate to the rate of flow through the thickness of the pressure sensitive adhesive layer. For example, where a silicone coated release paper is used the paper may be impregnated with the inorganic salt or conductive resin or conductive particles. Even better results are achieved, if, in addition, such resin or salt is added to the silicone coating. However, in such case the amount added should not be so great as to unduly interfere with the release properties of the silicone.

In this way, the entire thickness of the substrate for the electrophotographic layer from the inner electrophotographic surface to the outer release paper surface is conductive.

Where a unipotential layer is used, electrophotographic reproduction is not at all impaired by the use of conventional non-conductive release sheets.

DETAILED DESCRIPTION

EXAMPLE 1

An electrophotographic coating composition is made up by adding 44.04 grams of a 45% by weight toluene solution of a modified acrylic polymer, which solution is sold by DeSoto Chemical Company, Chicago, Illinois, under the trade name DeSoto E-O 41 resin, to 114.6 grams of toluene and admixing therewith 120 grams of photoconductive zinc oxide, sold by the New Jersey Zinc Co. under the name, Florence Green Seal No. 8 (ultimate particles size of 0.3–0.4 microns), and 1.5 ml of a 1% methanol solution of sensitizing dye (0.29 grams bromophenol blue, 0.59 grams uranine (USP) plus 0.135 grams methylene blue dissolved in 99 grams methanol).

The aforesaid coating composition is coated onto the aluminum surface of an aluminum foil laminated kraft paper, sold by Reynolds Metals Company (aluminum foil thickness of 0.2–0.6 mils and paper thickness of 1 to 4 mils), with a meier rod in an amount equal to twenty pounds per 24×36 500 sheet ream followed by drying to provide an electrophotographic coating layer having an average thickness of 0.6–1.0 mil or 15–25 microns. The aluminum surface of the aluminum foil laminated kraft paper to which the electrophotographic coating composition is applied, has a very thin coating (less than one lb. of resin per 3,000 foot square ream, sometimes referred to as a washcoat) of polyvinyl acetate lacquer thereover, which gives good adhesion between the electrophotographic coating and the aluminum surface.

A pressure sensitive adhesive solution is prepared as follows:

Styrene-butadiene rubber: 100 g.
Hydrogenated wood rosin: 50 g.
Toluene (solvent): 300 g.
Antioxidant (2.4-di(tert.-amyl) hydroquinone sold under the name SANTOVAR A by Monsanto Chemical Company): 3 g.

and is coated on the silicone surface of a conventional silicone coated release paper, i.e. a 50 lb. Deerfield Release Paper sold by Deerfield Paper Company, in the amount of 9–10 lbs. of adhesive resin solution per 24×36 500 sheet ream and dried to provide a highly pressure sensitive adhesive layer about one mil thick.

The paper surface of the electrophotographic layer—aluminum foil laminated kraft paper laminate is then pressed against the exposed pressure sensitive adhesive surface of the pressure sensitive adhesive—release sheet laminate to adhere the two laminates together by virtue of the adhesiveness of the pressure sensitive adhesive and to thereby form the composite electrophotographic pressure sensitive sheet.

The composite electrophotographic pressure sensitive sheet, the upper surface of which comprises the electrophotographic layer and the lower surface of which comprises the release paper, is then cut or perforated by a dye into labels with the cut or perforation lines extending through the electrophotographic coating, the aluminum foil laminated paper and the pressure sensitive adhesive layer but not through the release sheet so that the release sheet comprises a backing sheet to which the electrophotographic pressure sensitive labels are adhered but from which they can be individually removed and stuck to a receiving surface.

Electrophotographic copies are made on such labels while applied to the release sheet from a black and white master in a Dennison Standard Electrophotograhic Copier using Graphofax toner sold by Phillip A. Hunt Chemical Company and with an exposure time of seven seconds. The labels, releasably adhered to the release sheet, are charged, exposed and toner developed in the copier in conventional manner.

Excellent reproduction is achieved, which is as good as that achieved with standard electrophotographic paper.

The developed labels are peeled off the release sheet and pressed onto a receiving surface. The peeling (release) and pressure sensitive adhesion properties are excellent and are not effected by the charging, exposure and toner developing steps in the copier.

EXAMPLE 1A

Same as Example 1, except the aluminum foil laminated paper is replaced with a standard Electrofax conductive base paper sold by Weyerhauser Paper Company under the designation CCA. Electrophotographic reproduction is quite poor and unsatisfactory.

EXAMPLE 2

Same as Example 1, except that (1) the electrophotographic composition is coated onto an Electrofax conductive base paper sold by Weyerhauser Paper Company under the designation CCA, which has a hold-out and conductive layer of clay, protein and quaternary ammonium polymer, to which the electrophotographic coating composition is applied, and (2) the pressure sensitive adhesive solution has conductive zinc oxide particles added thereto to make the pressure sensitive adhesive layer conductive and is as follows:

Poly Crepe: 100 g.
Coumaron indene resin: 60 g.
Toluene: 310 g.
Antioxidant: 3 g.
Conductive zinc oxide particles (sold under the name Zinc Oxide #2698 by New Jersey Zinc Co.): 100 g. (volume ratio of poly crepe coumaron indene resin to zinc oxide of about 3.5/1)

Although the quality of reproduction, the adhesiveness of the pressure sensitive adhesive and the release characteristics of the release sheet are not as good as Example 1, they are satisfactory.

EXAMPLE 3

Same as Example 2, except the release sheet is a glassine sheet impregnated with conductive Dow QX 2611.12 resin in an amount equal to 2 pounds per 24×36 500 sheet ream and coated with a thin layer of silicone resin. Reproduction is improved over Example 2 but is still not as good as Example 1. Adhesive and release properties are about the same as Example 2.

EXAMPLE 4

Same as Example 2 except the conductive zinc oxide is replaced by 18 grams of Dow QX 2611.12. Reproduction quality is about the same as Example 2 but the pressure sensitive adhesive properties and release properties are not as good.

The conductive zinc oxide particles in the pressure sensitive adhesives of Examples 2 and 3 can be replaced by other finely divided electrically conductive metals such as silver or gold or copper or aluminum flakes or granules or powders or finely divided carbon powders, e.g. graphite.

In Examples 2 and 3, volume ratio of pressure sensitive adhesive to conductive particles in the dried pressure sensitive adhesive layer may range from about 11/1 to 1/1, more preferably from 8/1 to 2/1.

In example 4, the amount of conductive resin in the dried pressure sensitive adhesive layer may range from 1 to 20%, more preferably from 5 to 15%, by weight of the pressure sensitive adhesive.

Where inorganic salts are added to the pressure sensitive adhesive layer they may be used in a volume ratio of inorganic salt to pressure sensitive adhesive of between 1/10 and 1/1.

Other conventional electrophotographic coating compositions can be used. Thus, the zinc oxide can be replaced by other photoconductive materials such as zinc cadmium sulfide, zinc sulfide, cadmium sulfide, titanium dioxide of very fine particle size, zinc cadmium selenide, selenium telluride, mercuric sulfide, selenium sulfide, stilbene, polyvinyl carbozole, imidizole derivities and anthracene; the insulator resin can be replaced by other electrophotographic insulator resinous binders such as the alkyd resins, silicone resin, vinyl resins, e.g. polyvinylacetate and polyvinyl chloride homopolymers and copolymers, polyurethane, styrene, acrylonitrile, butadiene-styrene; the sensitizer can be replaced by any conventional and compatible sensitizer; and the weight ratio of photoconductive particles to resin binder may range between 1/1 and 8/1 or higher.

Also the electrophotographic layer can be applied to the substrate, be it metal or paper or plastic, in any conventional manner but preferably as a dispersion of the photoconductive particles in a solution of the resin in a solvent.

The thickness of the electrophotographic layer is conventional and may range from 0.3–1.0 mil.

In Example 1 any highly conductive thin flexible metal foil forming a continuous metal surface can be used, such as silver, gold, copper, etc. and it can be laminated with flexible resin coatings, such as polyvinyl resin coating, rather than paper.

Preferably, the continuous metal layer is quite thin, e.g. between 0.1 and 0.8 mils thick, whereas the paper or resin sheet thickness may vary from 0.5 to 4 or 6 mils or more in thickness.

Furthermore, the pressure sensitive adhesives of the examples can be replaced with other conventional pressure sensitive adhesives, such as acrylic-polyvinyl acetate copolymers laid down from an ethyl acetate-toluene solvent, polyvinyl ether, polyvinyl alcohol, plasticized polyisobutylene, plasticized rubber, plasticized poly esters, plasticized butadiene-styrene, etc. These resins may be plasticized with conventional plasticizers, such as the oleates, oil, phthalates, e.g. dioctyl phthalate, tricresyl phosphate, poly-alpha methyl styrene, etc. to achieve the tackiness and strength required.

Preferred pressure sensitive adhesives are those comprising a mixture of a highly tacky resin, i.e. tackifying agent, such as a hydrogenerated wood rosin or coumaron indene resin, and a less tacky back-bone resin such as styrene-butadiene, rubber or poly crepe for strength and control of tackiness.

The reduction in tack of the pressure sensitive adhesive caused by the addition of conductive particles or conductive resins, which are tack reducers can be compensated for by increasing the ratio of tackifying agent to the less tacky back-bone resin or by the use of a more tacky tackifying agent.

Where a liquid toner is to be used for development it is preferred to use in the pressure sensitive adhesive layer a polyacrylic resin, e.g. a poly acrylic-vinyl acetate copolymer, which is resistant to the liquid carrier of the toner, e.g. odorless mineral spirits, used in the developing step.

The thickness of the pressure sensitive adhesive layer is the same as that in conventional pressure sensitive labels, e.g. between 0.8 and 1.2 mils.

In Example 3, the amount of conductive resin with which the release paper is impregnated may range from 1 to 5 lbs. per 24×36 500 sheet ream.

The invention has been described in detail with respect to preferred embodiments thereof, but it will be understood that variations and modifications can be effected within the spirit and scope of the invention as defined in the appended claims.

We claim:

1. An electrographic member which can be used as a mailing label and the like, comprising a conductive base member having oppositely positioned outer surfaces, an electophotographic layer on one of said surfaces for the formation of an electrostatic image therein, a non water-soluble pressure sensitive adhesive layer on the other of said surfaces, and a release sheet temporarily overlying said adhesive layer, the conductivity of said pressure sensitive adhesive layer being controlled by the addition of a water-soluble conductive material to permit the transport of charges through said adhesive layer in the formation of said electrostatic image without impairment of the adherence of said adhesive layer to said release sheet and to a receiving surface when said release sheet is removed.

2. An electrographic member as defined in claim 1 wherein said release sheet is a conductive member.

3. An adhesive electrographic member as defined in claim 1 wherein said adhesive layer is formed by an ionizable resin present in an amount equal to between 5 and 15% dry weight of the pressure sensitive adhesive.

4. An adhesive electrographic member as defined in claim 1 wherein a protective sheet permitting the transport of electrons therethrough is releasably adhered to said adhesive sheet.

5. An electrographic member as defined in claim 1 wherein said release sheet is a glassine silicone coated member.

6. An adhesive electrographic member as defined in claim 1 wherein said adhesive layer is applied through an adhesion promoting layer formed from one or more members of the class consisting of polyvinyl chloride, polyvinyl acetate, styrenebutadiene, nitrocellulose and copolymers of polyvinyl chloride and polyvinyl acetate.

7. An adhesive electrographic member as defined in claim 1 where said water soluble conductive material is a resin selected from the class of polyquaternary ammonium resins, including polyvinyl benzyl trimethyl ammonium chloride.

8. An electrographic member as defined in claim 1 wherein said non-water-soluble adhesive is selected from the class of mixtures of styrene-butadiene rubber and hydrogenated wood rosin with an antioxidant; mixtures of polycrepe and coumarin indene resin with an antioxidant, acrylic polyvinyl acetate copolymers laid down from an ethyl acetate-toluene solvent, polyvinyl ether, plasticized polyisobutylene, plasticized rubber, plasticized polyesters, and plasticized butadiene-styrene.

9. An electrographic member as defined in claim 1 wherein a charge-sensitive layer is included on the other side of said base member formed from an insulator resin bound by a photoconductive material selected from the class consisting of zinc oxide, zinc cadmium sulfide, zinc sulfide, cadmium sulfide, titanium dioxide, zinc cadmium selenide, selenium telluride, mercuric sulfide, selenium sulfide, stilbene, polyvinyl carbozole, imidizole derivitives and anthracene.

* * * * *